US009221578B2

(12) United States Patent
Timmerman

(10) Patent No.: US 9,221,578 B2
(45) Date of Patent: Dec. 29, 2015

(54) VENDING MACHINE FOOD BOTTLE WITH INLET AND OUTLET VALVE

(76) Inventor: Aaron J. Timmerman, Rosemount, MN (US)

( * ) Notice: Subject to any disclaimer, the term of this patent is extended or adjusted under 35 U.S.C. 154(b) by 0 days.

(21) Appl. No.: 13/213,724

(22) Filed: Aug. 19, 2011

(65) Prior Publication Data

US 2012/0048826 A1 Mar. 1, 2012

Related U.S. Application Data

(60) Provisional application No. 61/376,852, filed on Aug. 25, 2010.

(51) Int. Cl.
*B65D 8/00* (2006.01)
*B65D 81/20* (2006.01)

(52) U.S. Cl.
CPC ..... *B65D 11/04* (2013.01); *B65D 81/20* (2013.01); *B65D 2205/02* (2013.01)

(58) Field of Classification Search
CPC . A61M 3/0233; A61M 11/02; B65D 2205/02
USPC ..... 215/316, 11.5, 11.1, 387, 232, 311, 215/11.6; 220/359.1, 23.83, 714, 745; 206/217; 222/153.1
See application file for complete search history.

(56) References Cited

U.S. PATENT DOCUMENTS 2,778,519 A * 1/1957 McFarlane ..... 206/232
3,071,272 A * 1/1963 Doner ..... 215/11.1
3,348,716 A * 10/1967 Nakata ..... 215/6
3,768,683 A * 10/1973 Van Den Bosch ..... 215/11.5
4,069,935 A * 1/1978 Hampel ..... 215/203
4,259,954 A * 4/1981 Scott ..... 604/290
4,703,849 A 11/1987 Vezirian et al.
4,703,863 A * 11/1987 Kohus ..... 215/11.1
4,984,717 A 1/1991 Burton
5,000,332 A * 3/1991 Whitacre ..... 215/330
5,613,620 A 3/1997 Center et al.
5,664,671 A 9/1997 Nedblake, Jr.
6,006,945 A 12/1999 Kirkland
6,070,766 A * 6/2000 Long, Jr. ..... 222/153.07
6,079,589 A * 6/2000 Matsuyama et al. ..... 220/715
6,253,936 B1 * 7/2001 Kong ..... 215/11.3
6,296,129 B1 * 10/2001 Kawasaki ..... 215/12.1
6,363,978 B2 4/2002 Castillo
6,723,360 B1 4/2004 Dunaway
6,989,168 B2 1/2006 Fahey
7,219,811 B2 * 5/2007 Kong ..... 215/11.3

(Continued)

FOREIGN PATENT DOCUMENTS

JP 06298256 10/1994

*Primary Examiner* — Anthony Stashick
*Assistant Examiner* — Raven Collins
(74) *Attorney, Agent, or Firm* — William Mitchell IP Clinic

(57) ABSTRACT

A food bottle comprising a body member, a top member, a first engagement section, a second engagement section and a feature, is disclosed. The body member comprises a top end and a container section. The top member comprises a neck section and a cap, wherein the neck section comprises a top end and a bottom end. The first engagement section is the section where the top end of the body member engages with the bottom end of the neck section of the top member. The second engagement section is the section where the top end of the neck section of the top member engages with the cap of the top member. The feature can be a valve, plug, vent, or the like.

20 Claims, 10 Drawing Sheets

(56) References Cited

U.S. PATENT DOCUMENTS

| | | | | |
|---|---|---|---|---|
| 7,850,027 | B2 * | 12/2010 | Hayes et al. | 215/11.4 |
| 2005/0123657 | A1 | 6/2005 | Beckman | |
| 2006/0131188 | A1 | 6/2006 | Lindemann | |
| 2006/0151414 | A1 | 7/2006 | Mullen | |
| 2006/0261096 | A1 * | 11/2006 | Alei | 222/481.5 |
| 2007/0026112 | A1 | 2/2007 | Zimmerman et al. | |
| 2007/0221602 | A1 * | 9/2007 | Dib | 215/6 |
| 2007/0290012 | A1 * | 12/2007 | Jackman | 222/541.4 |
| 2010/0314349 | A1 * | 12/2010 | Chen | 215/316 |

* cited by examiner

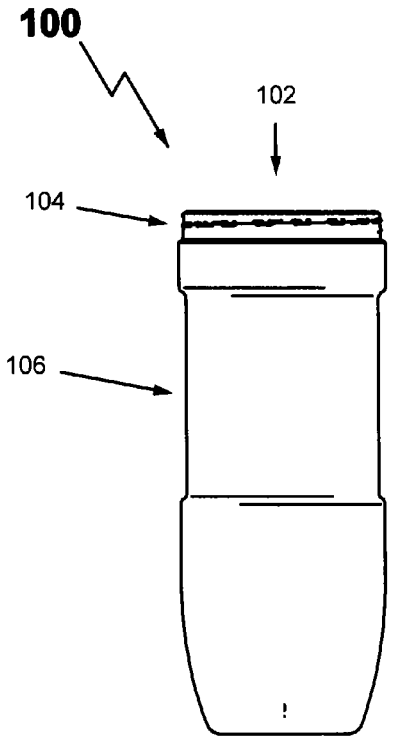
Fig 1A
Fig 1B
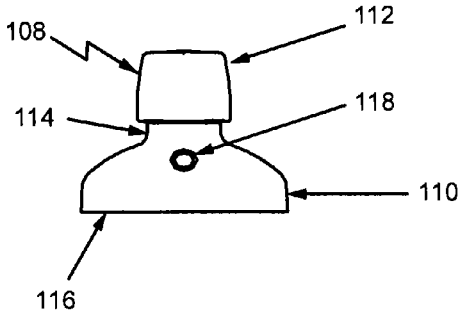
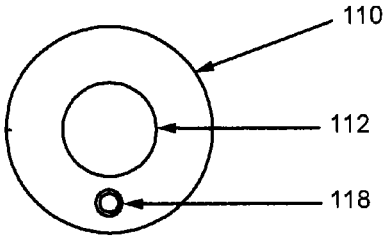
Fig 1C

VENDING MACHINE FOOD BOTTLE WITH INLET AND OUTLET VALVE

RELATED APPLICATIONS

This application claims priority to U.S. Provisional Application Ser. No. 61/376,852 filed with the United States Patent and Trademark Office on Aug. 25, 2010, which is incorporated herein by reference in its entirety.

FIELD OF THE INVENTION

The invention generally relates to a food bottle. More specifically, the invention is a food bottle that is a container that contains a food product, which may be resealable, and is suitable for use in a vending machine.

BACKGROUND

The use of vending machines to dispense beverages, as well as food, to the consumer is a common practice at work and public places, schools, recreational areas, and countless other places. However, in recent years challenges have been posed to the beverage vending industry. For example, some schools have banned the sale of sugared beverages, such as pop, soda, and other carbonated beverages, for health reasons. This can leave numerous slots open in the vending machines that once vended such soft drinks. The removal of such soft drinks can create an opportunity to fill these empty slots with another product. However, trying to find an item that has a suitable size and shape that would allow easy replacement into these slots creates a specific problem.

While there are vending machines already on the market that have the ability to vend food products, because of the different types of packaging required or used for these food products, many of the sites that have vending machines require two different machines: one for beverages and one for food items. This need for additional machines leads to increased costs associated with energy consumption and maintenance of these machines. Therefore, it is desirable to have a vending machine that is capable of vending both food items and beverages from one machine.

While some efforts have been made to solve this problem, they have been limited to using aluminum cans to package the food product. This presents certain challenges, for example, such cans are not resealable. A further problem with the use of aluminum cans is associated with the current trend of using bottles in beverage dispensing machines. Aluminum cans are not the same size and shape of current plastic soda bottles. Thus, these cans may pose compatibility issues in dispensing from these beverage bottle vending machines. Therefore, there is a need for a container that can contain food and is compatible with current-style beverage vending machines, where the container can be vended in the same beverage vending machines.

SUMMARY OF THE INVENTION

The following embodiments of the food bottle may be used for the purpose of vending a food item from a vending machine that also dispenses beverages. The design of the food bottle allows for its use in a beverage vending machine without any modification to the vending machine. Further, the food bottle may be resealable once the bottle has been opened.

Additionally, the food bottle may be purchased from a retail, wholesale or other store, wherein the consumer may purchase the food bottle and store, use, reuse, transport, etc. food items for the consumer's own benefit. One benefit of the food bottle is the ability to place the food bottle with the food product inside into existing cup holders within a vehicle. This is advantageous to an adult driver or passenger, and also for use by parents and their children. Parents can provide food items, such as snacks, to their children in the backseat or even kid seats by placing the food bottle into preexisting cup holders. The food bottle also has the ability of being resealable so that the top may be placed back onto the body to keep the contents of the food bottle from spilling, dumping, or otherwise coming out of the food bottle.

One embodiment of the food bottle generally relates to a resealable container, wherein the container may be in the form of a plastic bottle. Such food bottle comprises a body member, a top member, a first engagement section, a second engagement section and a feature. The body member comprises a top end and a container section, the container section being such that food items may be disposed within the cavity of the container section.

The top member comprises a neck section and a cap, wherein the neck section comprises a top end and a bottom end. The first engagement section is the section in which the top end of the body member engages with the bottom end of the neck section of the top member. The engagement of the body member and the top member may be through the use of threading wherein the top member can be screwed onto the body member, as well as through the use of complementary mating devices, for example lips, detents, projections, recesses, and the like. Thus, for example, the body member and the top member may be snap-fit together.

The second engagement section is the section where the top end of the neck section of the top member engages with the cap of the top member. The engagement of the top end of the neck section and the cap may be through the use of threading wherein the cap can be screwed onto the top end of the neck section of the top member of the food bottle, or, alternatively, through the use of other coupling devices for example, lips, detents, projections, recesses, and the like.

The feature can be a valve, plug, air hole and the like. The feature can be used to evacuate or otherwise purge the food bottle of air by introducing, for example, an inert gas like nitrogen, into the food bottle to keep the food items from spoiling. Alternatively, instead of just having one feature, an embodiment can have more than one feature, such that one may be a way of dispelling air from the food bottle and the other allows for the filling of an inert gas, such as nitrogen, into the food bottle.

BRIEF DESCRIPTION OF THE DRAWINGS

These as well as other objects and advantages of the food bottle will be more completely understood and appreciated by referring to the following more detailed description of the exemplary embodiments of the food bottle in conjunction with the accompanying drawings of which:

FIG. 1A is a perspective side view of an embodiment of a body portion of a food bottle;

FIG. 1B is a perspective side view of an embodiment of a top portion of a food bottle;

FIG. 1C is a perspective top view of an embodiment of a top portion of a food bottle;

Figure 2:
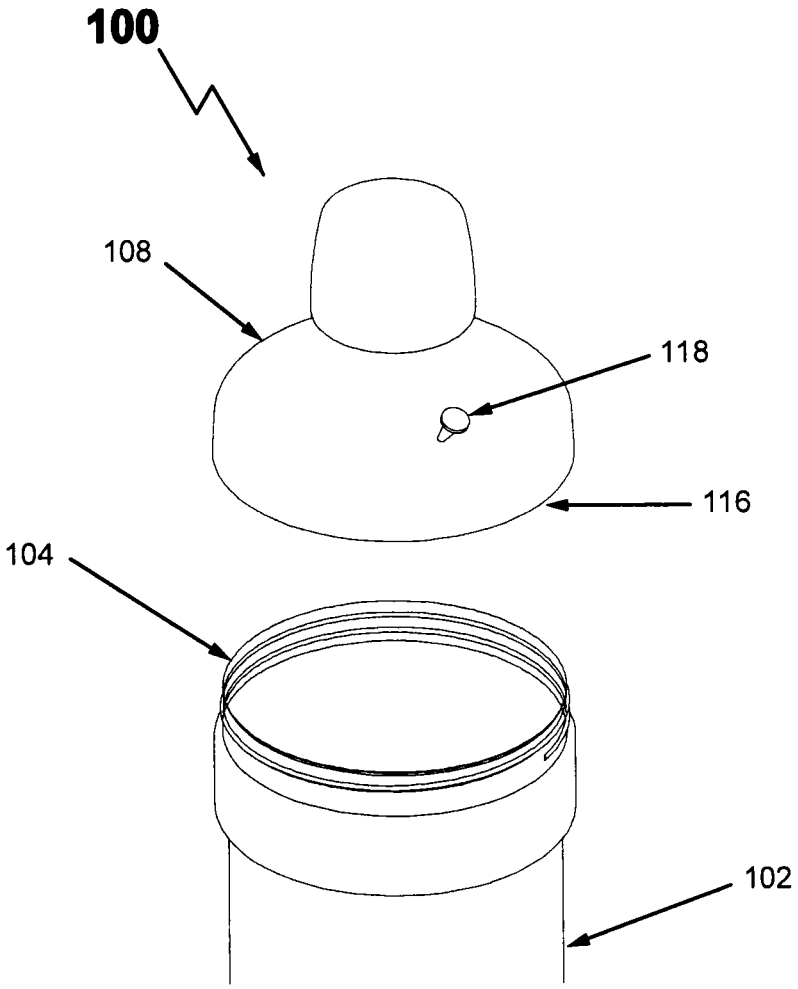
FIG. 2 is an exploded view of an embodiment of a food bottle, including a feature.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives.

DETAILED DESCRIPTION

The several embodiments, as shown in the figures, allow the user of the food bottle to have multiple choices of certain features and subcombinations of each embodiment, as there are several choices available relating to the several embodiments. Advantages and embodiments of the food bottle are further illustrated by the following examples, but the particular materials thereof recited in these examples, as well as other conditions and details, should not be construed to unduly limit this invention.

The food bottle 100 as described more fully below in FIGS. 1-6 may be of substantially the same size and shape as that of a typical beverage bottle that is dispensed from a vending machine. The bottle is preferably made from plastics that include but are not limited to polyethylene terephthalate and other recyclable plastics. Alternatively, the bottle can also be made of glass or other suitable materials. The food bottle can be made by vacuum forming, blow molding, and other methods known to those skilled in the art.

The food bottle 100 alternatively, as described more fully below in FIG. 7, can be of the same shape of a beverage bottle and of varying sizes, such that a consumer may purchase the food bottle from a retail outlet, wholesale outlet or other store, for the consumer's use in storing and transporting food products.

FIG. 1A is a perspective side view of an embodiment of a body member 102 of a food bottle. The body 102 can include a top end 104 and container section 106 The top end 104 can include male threading such that the top end 104 can be releasably engaged with the top member 108 of a food bottle 100, as more fully described in FIG. 1B below. The container section 106 can be used to house food items within the cavity of the container section 106.

FIG. 1B is a perspective side view of an embodiment of a top member 108 of a food bottle 100. The top member 108 can include a neck section 110 and cap 112. The neck section 110 can include a top end 114 and a bottom end 116. The top end 114 can be of a smaller diameter than the bottom end 116, wherein the neck section 110 increases in diameter from the top end 114 to the bottom end 116. The top end 114 can include male threading such that the top end 114 can be screwed into the cap 112, wherein the cap 112 can include female threading such that the cap 112 can be releasably engaged with the top end 114. Alternatively, the cap 112 can be permanently engaged with the top end 114, such that the cap 112 cannot be removed from the top end 114.

The bottom end 116 can include female threading (not shown), wherein the bottom end 116 can be engaged with the top end 104 of the body member 102 of the food bottle. Alternatively, in another embodiment, the bottom end 116 of the top member 108 may be releasably engaged with top end 104 of the body member 102 of the food bottle by a series of recesses, projections, detents, a lip, and the like.

The neck section 110 can also include a feature 118, wherein the feature 118 can be used to evacuate or purge air from the food bottle, for example, by replacing the air within the food bottle with nitrogen, or other suitable inert gas known to those skilled in the art, for the use of storing food items in a sealed container. The feature 118 can be a valve, a plug, or the like, such that the replacement of air by, for example, nitrogen can be accomplished.

FIG. 1C is a perspective top view of an embodiment of a top member 108 of a food bottle including the neck section 110, the cap 112, and the feature 118.

FIG. 2 is an exploded view of an embodiment of a food bottle, including a feature 118. The embodiment can comprise a body member 102, a top member 108, and a feature 118. The body member 102 can include a top end 104, which top end 104 has male threading. The top member 108 can include a bottom end 116, which bottom end 116 has female threading (not shown) such that the bottom end 116 of the top member 108 can be releasably engaged with the top end 104 of the body member 102.

The top member 108 can also include a feature 118. The feature 118 can be used to evacuate or purge air from the food bottle, for example, by replacing the air within the food bottle with nitrogen, or other suitable inert gas known to those skilled in the art, for the use of storing food items in a sealed container. The feature 118 can be a valve, a plug, or the like, such that the replacement of air by, for example, nitrogen can be accomplished.

Figure 3:
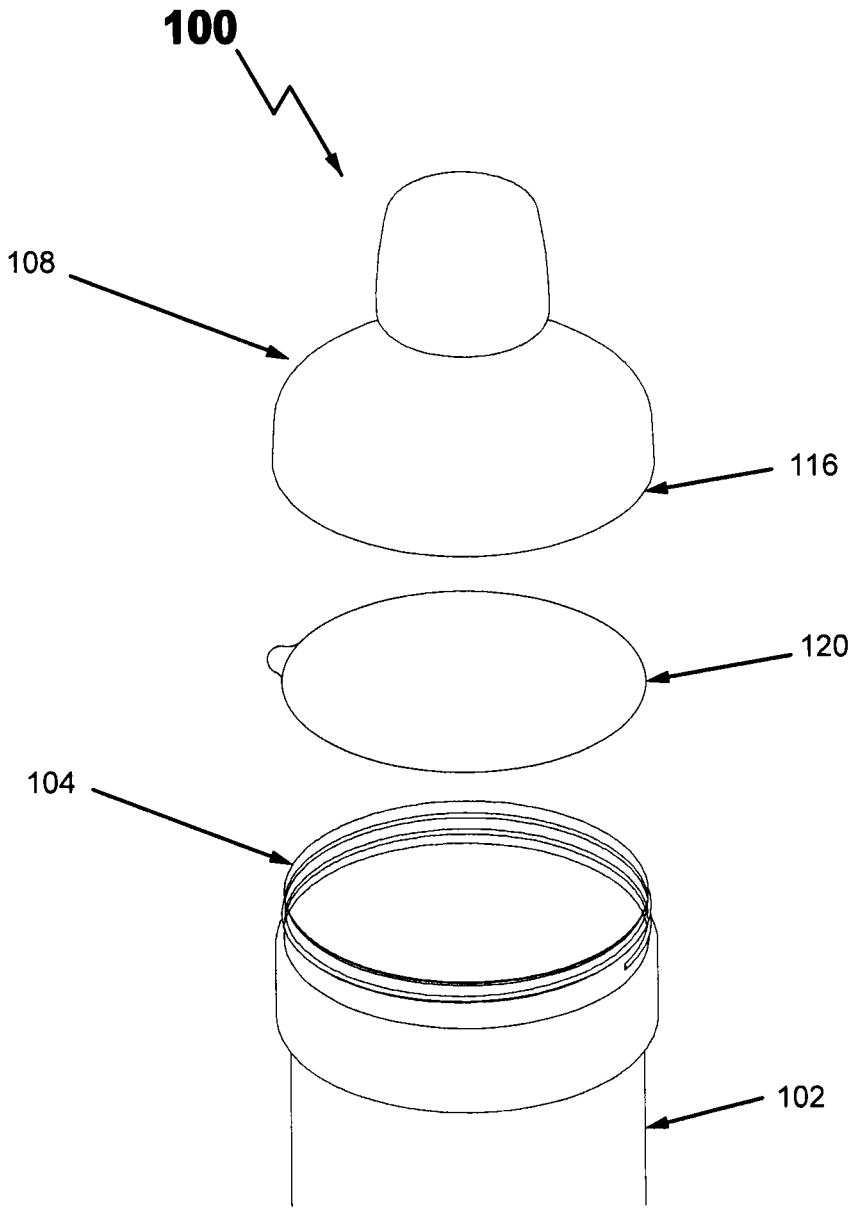
FIG. 3 is an exploded view of an embodiment of a food bottle, including a removable seal.

FIG. 3 is an exploded view of an embodiment of a food bottle 100, including a removable seal 120. The embodiment can comprise a body member 102, a top member 108, and a seal 120. The body member 102 can include a top end 104, which top end 104 has male threading. The top member 108 can include a bottom end 116, which bottom end 116 has female threading (not shown) such that the bottom end 116 of the top member 108 can be releasably engaged with the top end 104 of the body member 102.

A seal 120 can be placed between the body member 102 and the top member 108, such that the seal 120 can cover the body member 102, wherein the seal 120 is releasably attached to the top surface of the top end 104 of the body member 102. The seal 120 can be made out of paper, foil, plastic, and the like, or any combination thereof. The seal 120 can be attached to the top surface of the top end 104 by use of an adhesive or the like. In operation, the seal 120 remains firmly attached to the body 102 until a user removes the seal 120 from the top end 104 of the body 102 to gain access to the enclosed food items. The seal 120 can provide a means for vacuum or otherwise sealing the food items within the body member 102 of the food bottle.

Figure 4:
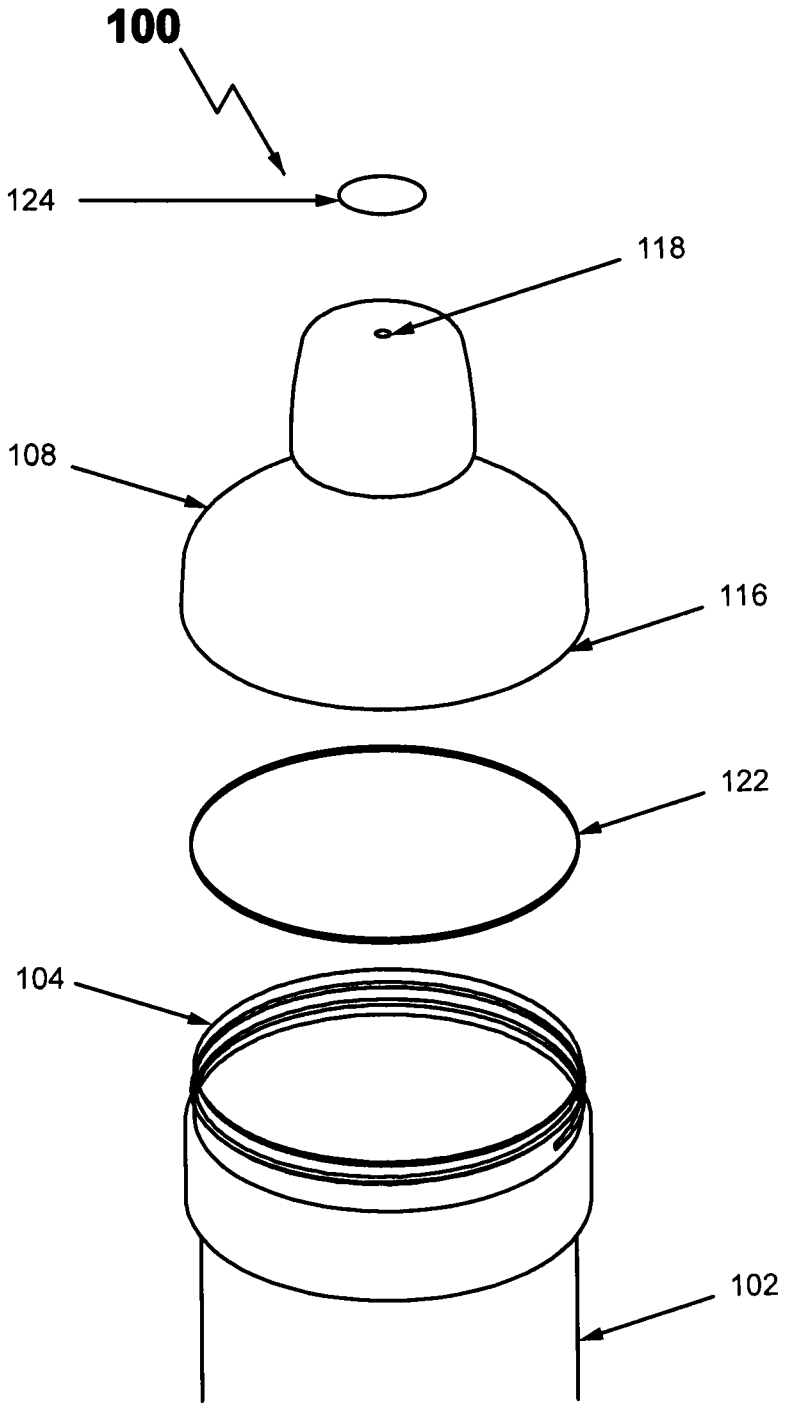
FIG. 4 is an exploded view of an embodiment of a food bottle, including a gasket.

FIG. 4 is an exploded view of an embodiment of a food bottle 100, including a gasket 122. This embodiment of a food bottle may comprise a body member 102, a top member 108, and a gasket 122. The body member 102 can include a top end 104, which top end 104 has male threading. The top member 108 can include a bottom end 116, which bottom end 116 has female threading (not shown) such that the bottom end 116 of the top member 108 can be releasably engaged with the top end 108 of the body member 102.

A gasket 122 can be disposed between the body member 102 and the top member 108, a first engagement section, such that when the top member 108 and body member 102 are coupled together, the gasket 122 forms a seal. The gasket 122 can be an o-ring, a washer-type seal, and the like. The gasket 122 can be made out of rubber, synthetic plastic, a composite type material or other suitable material. The gasket 122 can be coupled to the top end 104 of the body member 102 by use of an adhesive or the like. Alternatively, the gasket can be coupled to the bottom end 116 of the top member 108 by use of an adhesive or the like. In operation, the gasket 122 can be used to prevent the accidental or intentional detachment of the top member 108 from the body member 102. The gasket 122 can also be used as a seal to prevent leakage of, for example, liquid contents of the food bottle from escaping between the threading of the top end 104 and the bottom end 116 when the top member 108 is coupled to the body member 102.

Although not depicted in the figure, a gasket 122 can also be placed between the top end 114 of the neck section 110 of the top member 108 and the cap 112, wherein the cap 112 is releasably engaged with the neck section 110, a second engagement section. In operation, the gasket 122 can be used to prevent the accidental or intentional detachment of the cap 112 from the neck section 110. The gasket 122 can also be used as a seal to prevent leakage of, for example, liquid contents of the food bottle from escaping between the threading of the cap 112 and the neck section 110.

The top member 108 can also include a feature 118. The feature 118 can be used to evacuate or purge air from the food bottle, for example, by replacing the air within the food bottle with nitrogen, or other suitable inert gas known to those skilled in the art, for the use of storing food items in a sealed container. The feature 118 can be a valve, a plug, or the like, such that the replacement of air by, for example, nitrogen can be accomplished. The top member 108 can also comprise a cover 124, such that the cover 124 can be used to cover the feature 118.

Figure 5:
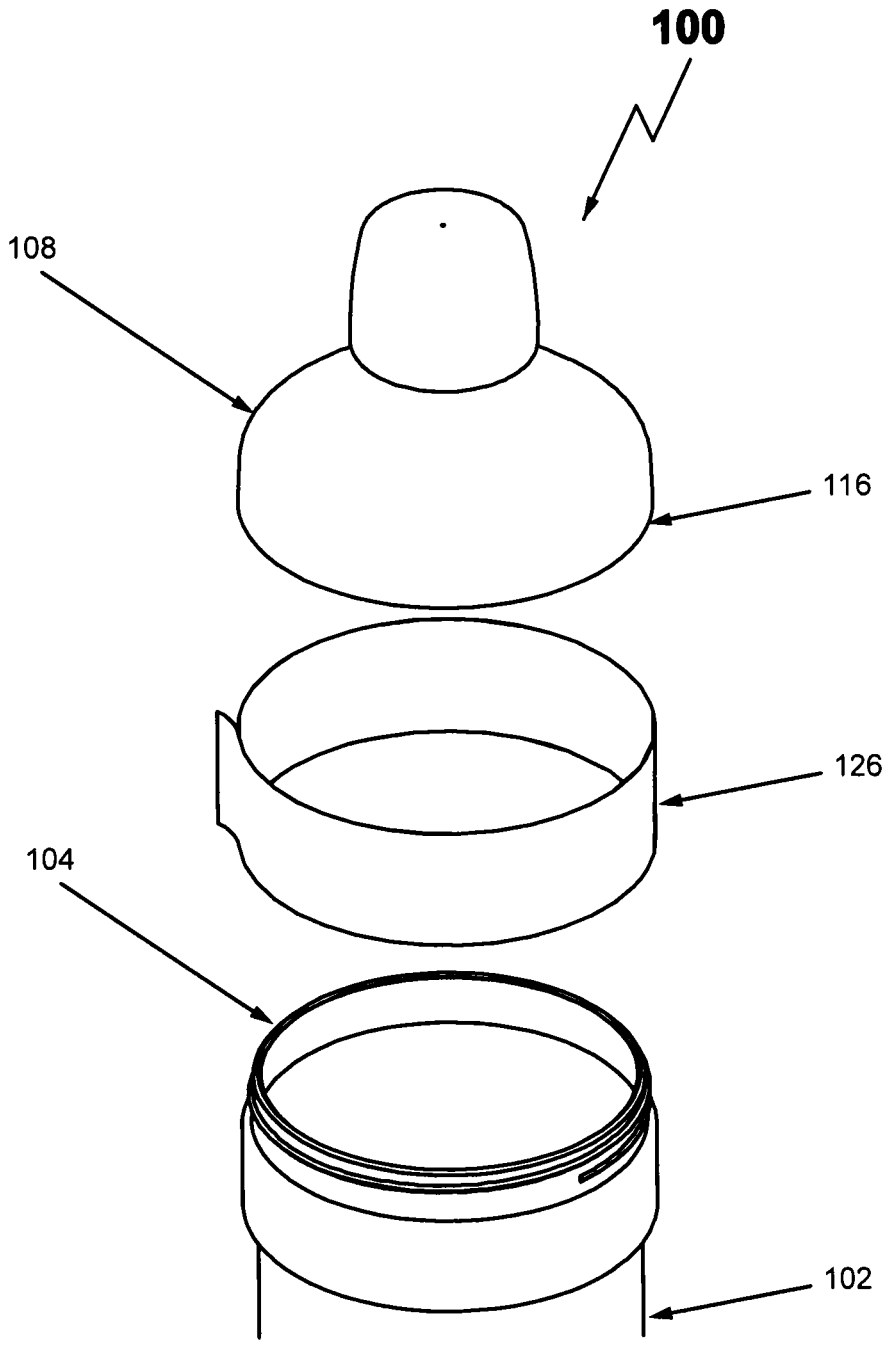
FIG. 5 is an exploded view of an embodiment of a food bottle, including a sealing band.

FIG. 5 is an exploded view of an embodiment of a food bottle 100, including a sealing band 126. This embodiment of a food bottle 100 can comprise a body member 102, a top member 108, and a sealing band 126. The body member 102 can include a top end 104, which top end 104 has male threading. The top member 108 can include a bottom end 116, which bottom end 116 has female threading (not shown) such that the bottom end 116 of the top member 108 can be releasably engaged with the top end 104 of the body member 102.

A sealing band 126 can be placed around the body member 102 and the top member 108, such that the band 126 overlaps both the body member 102 and the top member 108 at the area of the food bottle 100 where the body member 102 and the top member 108 are coupled to each other, a first engagement section. The sealing band 126 can be of multiple forms, such as a heat-activated sealing plastic or other material, wherein the band 126 is placed around the food bottle 100 at the first engagement section and heat is applied to the band 126 such that the band 126 shrinks to fit snuggly against the food bottle 100 overlapping the first engagement section. In another embodiment, the sealing band 126 can be an adhesive strip, such that the band 126 wraps around the food bottle 100 at the first engagement section and overlaps on itself. One advantage of the sealing band 126 is it can form an airtight seal around the food bottle 100 at the point of attachment of the body member 102 to the top member 108. Another advantage of the sealing band 126 is as a safety precaution to detect if there has been any tampering of the food bottle and/or its contents.

Figure 6:
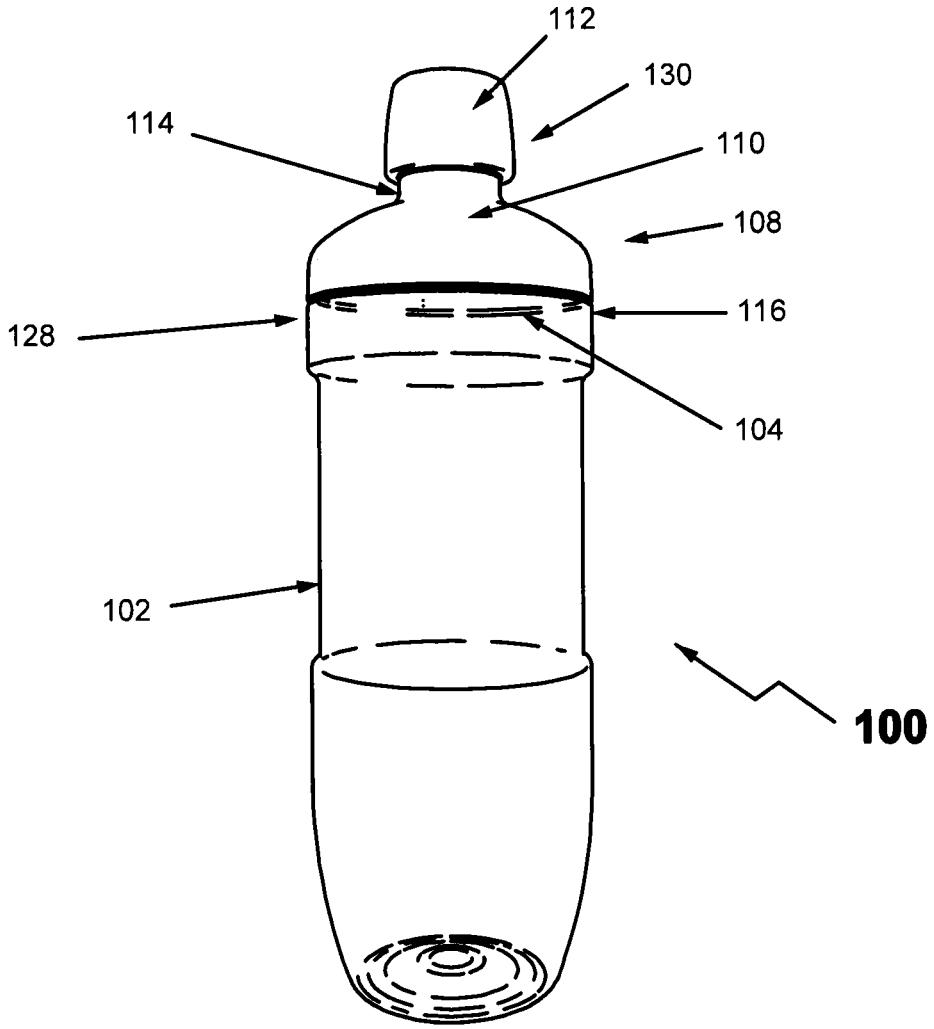
FIG. 6 is a perspective view of an embodiment of a food bottle.

FIG. 6 is a perspective view of an embodiment of a food bottle 100. This embodiment comprises a body member 102, a top member 108, a first engagement section 128, wherein the body member 102 and the top member 108 are releasably engaged with each other, and a second engagement section 130, wherein the top end 114 of the neck section 110 of the top member 108 engages with the cap 112 of the top member 108. This embodiment can include one or more or any combination of additional components as set forth in the above figures, including one or more features 118, a seal 120, a gasket 122, a feature cover 124, and/or a sealing band 126, as well as any other or additional components for use in the vending of the food bottle.

Figure 7:
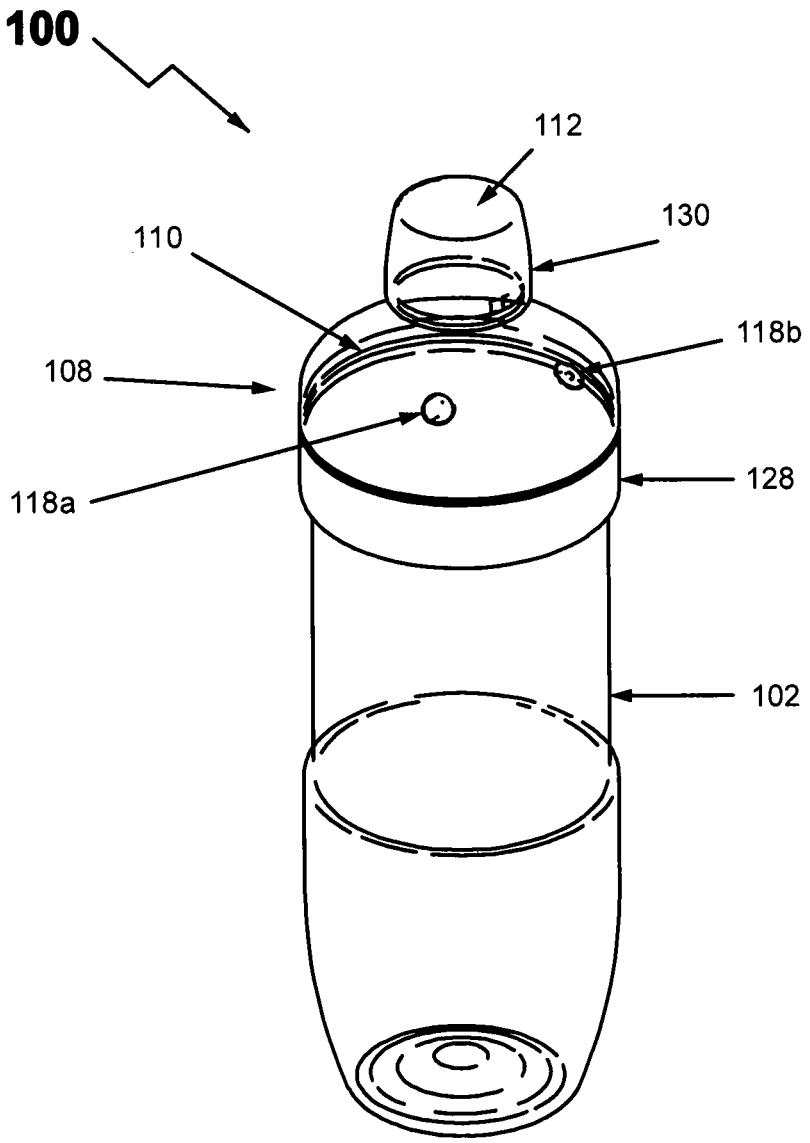
FIG. 7 is a perspective view of an embodiment of a food bottle.

FIG. 7 is a perspective view of an embodiment of a food bottle 100, wherein the embodiment is substantially similar to the embodiment as depicted in FIG. 6, comprising a body member 102, a top member 108, a cap 112, a first engagement section 128 and a second engagement section 130. The food bottle can be made of a hard plastic, such as high-density polyethylene, polyethylene terephthalate, polyvinyl chloride, and the like, wherein the food bottle can be reusable. Either or both of the first and second engagement sections 128, 130 can be releasably engaged such that the top member 108 can be removed from the body member 102 and the cap 112 can be removed from the neck section 110. The top member 108 can comprise at least two features 118*a*, 118*b*, such that both features 118*a*, 118*b* are located in the neck section 110. One feature 118*a* can be used as an air outlet, such that air within the food bottle 100 can be expelled from within the food bottle 100. The other feature 118*b* can be used as an inlet for an inert gas, such as nitrogen.

Figure 8:
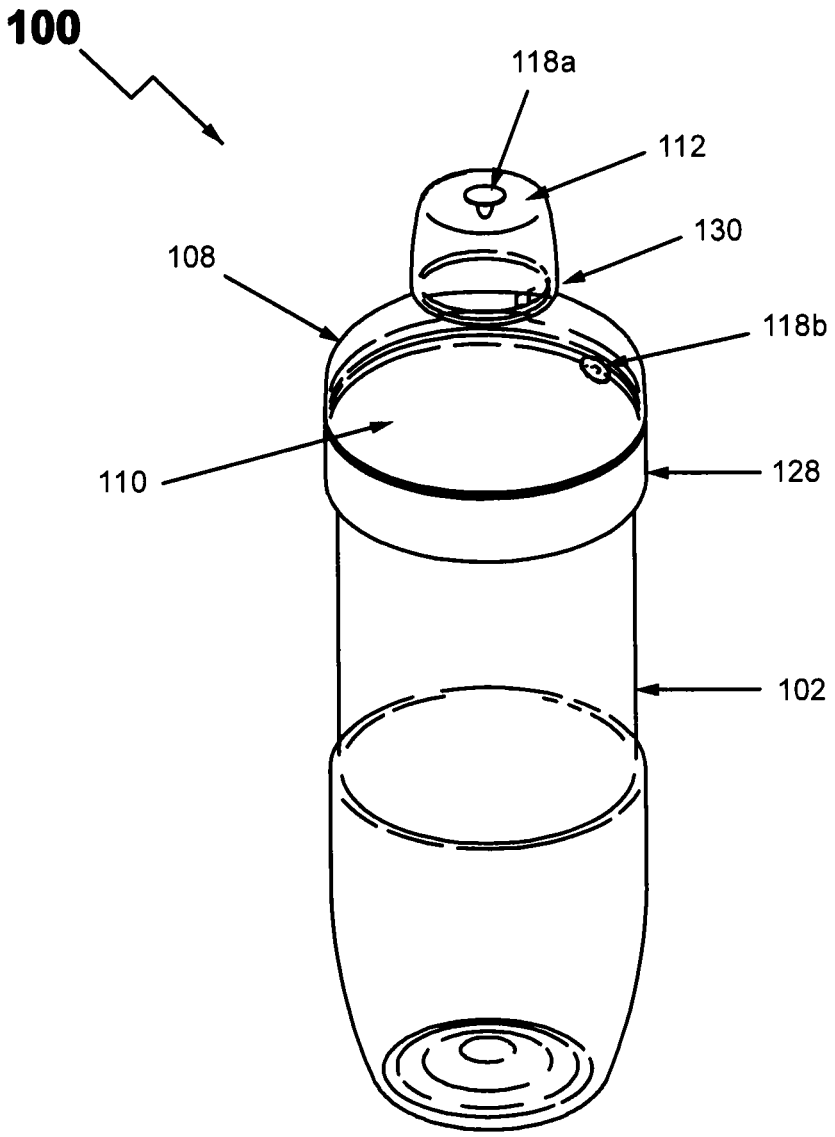
FIG. 8 is a perspective view of an embodiment of a food bottle.

FIG. 8 is a perspective view of an embodiment of a food bottle 100, wherein the embodiment is substantially similar to the embodiment as depicted in FIG. 6, comprising a body member 102, a top member 108, a cap 112, a first engagement section 128 and a second engagement section 130. The food bottle can be made of a hard plastic, such as high-density polyethylene, polyethylene terephthalate, polyvinyl chloride, and the like, wherein the food bottle 100 can be reusable. Either or both of the first and second engagement sections 128, 130 can be releasably engaged such that the top member 108 can be removed from the body member 102 and the cap 112 can be removed from the neck section 110. The top member 108 can comprise at least two features 118*a*, 118*b*, such that both features 118*a*, 118*b* are located in the top member 108 with one feature 118*a* located in the cap 112 and the other feature 118*b* located in the neck section 110. One feature 118*a* can be used as an air outlet, such that air within the food bottle 100 can be expelled from within the food bottle 100. The other feature 118*b* can be used as an inlet for an inert gas, such as nitrogen.

Figure 9:
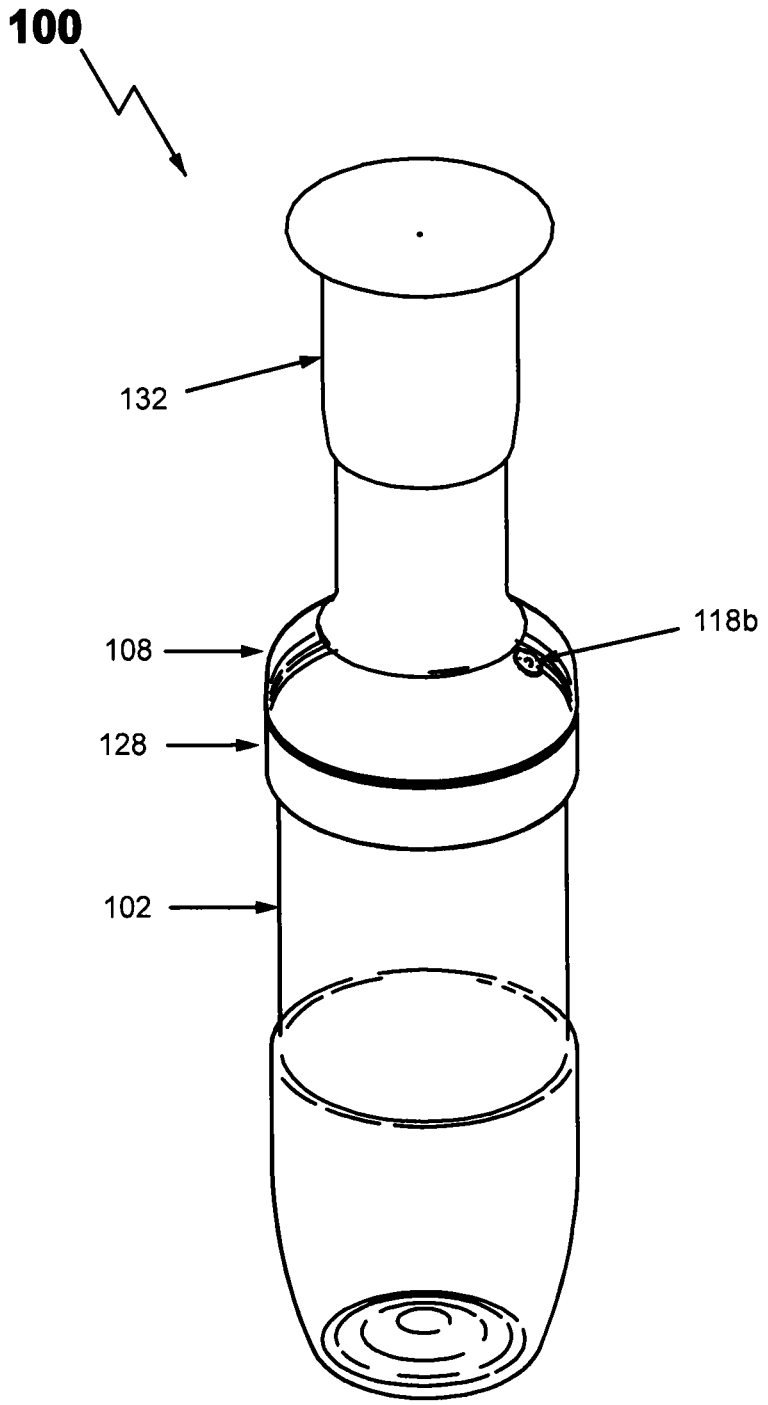
FIG. 9 is a perspective view of an embodiment of a food bottle, including a pump.

FIG. 9 is a perspective view of an embodiment of a food bottle 100, including a pump 132. The embodiment is substantially similar to the embodiment as depicted in FIG. 8, comprising a body member 102, a top member 108, a cap 112, a first engagement section 128 and a second engagement section 130. The food bottle can be made of a hard plastic, such as high-density polyethylene, polyethylene terephthalate, polyvinyl chloride, and the like, wherein the food bottle 100 can be reusable. Either or both of the first and second engagement sections 128, 130 can be releasably engaged such that the top member 108 can be removed from the body member 102 and the cap 112 can be removed from the neck section 110.

The top member 108 can comprise of at least two features 118*a* (not shown), 118*b*, such that both features 118*a* (not shown), 118*b* are located in the top member 108 with one feature 118*a* (not shown) located in the cap 112 (not shown) and the other feature 118*b* located in the neck section 110. One feature 118*a* (not shown) can be used as an air outlet, such that air within the food bottle 100 can be expelled from within the food bottle 100. The other feature 118*b* can be used as an inlet for an inert gas, such as nitrogen.

Additionally, a pump 132 can be used in connection with the food bottle 100 such that the pump 132 can be attached to the top member 108, such that the pump encapsulates the cap 112 and a feature, such as 118*a* (not shown), to pump air out of the food bottle 100. Where the food bottle 100 is made out of a type of plastic, the pump 132 can be used to remove some of the air within the food bottle, as removal of all of the air to create a vacuum seal can cause the food bottle to cave-in on itself. However, where the food bottle is made out of glass, the pump 132 can be used to pump substantially all air out of the food bottle 100 to create a vacuum seal within the food bottle 100. The pump 132 can be mechanical or electrical, powered by battery or an electrical cord that is plugged into a socket.

Figure 10:
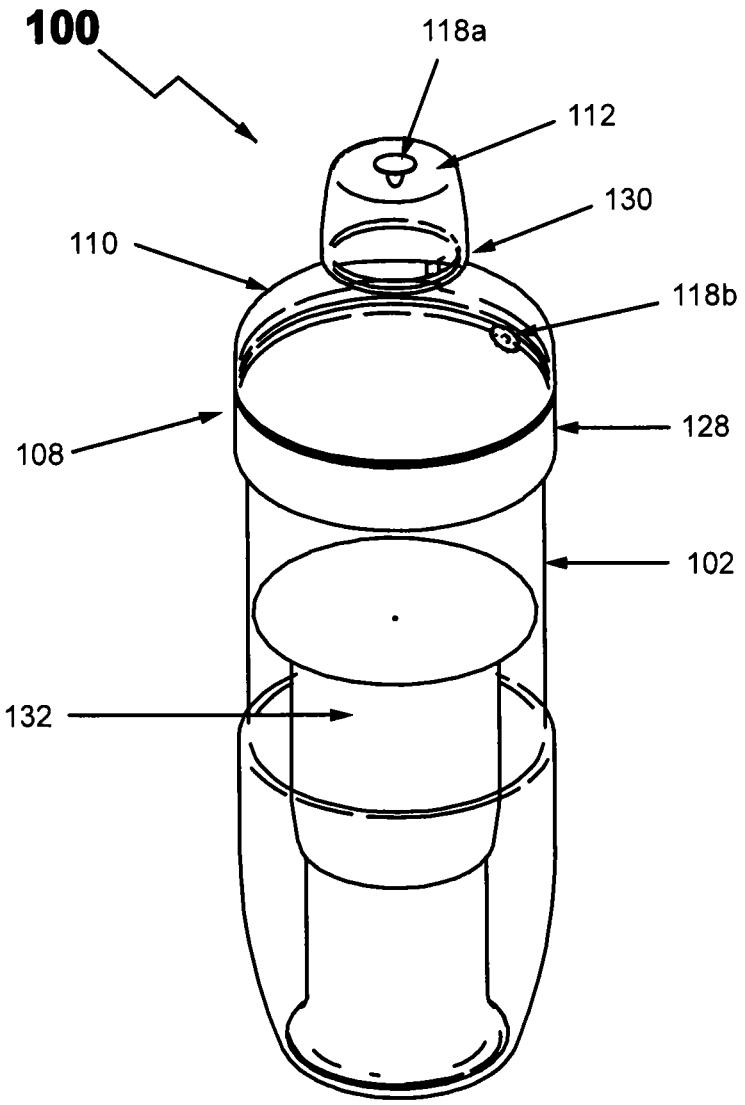
FIG. 10 is a perspective view of an embodiment of a food bottle, including a pump.

FIG. 10 is a perspective view of an embodiment of a food bottle 100, including a pump 132. The embodiment is substantially similar to the embodiment as depicted in FIG. 9. The pump 132 can be such that when the food bottle 100 is not in use by a consumer, the pump 132 can be stored within the cavity of the body member 102.

Various embodiments of systems, devices and methods have been described herein. These embodiments are given only by way of example and are not intended to limit the scope of the invention. For example, the coupling of the body member 100 to the top member 106 is described as coupling to one another through the use of threaded surfaces; however, other coupling devices, for example, projections, recesses, detents, a lip, snap-fit devices, and the like are contemplated. It should be appreciated, moreover, that the various features of the embodiments that have been described may be combined in various ways to produce numerous additional embodiments. Moreover, while various materials, dimensions, shapes, feature locations, etc. have been described for use with disclosed embodiments, others besides those disclosed may be utilized without exceeding the scope of the invention.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

What is claimed is:

1. A vending machine food bottle, comprising:

a body member defining a cavity configured to receive and store food, the body member comprising a top end and a container section; a top member separable from the body member, the top member comprising: a neck section having a top end, and a bottom end, a cap releasably attached to the top end, wherein the cap independently seals the top end;

an inlet feature located on the neck section and independently resealable, wherein the inlet feature is configured to receive an inert gas into the cavity from a pressurizing device external to the food bottle;

an outlet feature located on the neck section and independently resealable, wherein the outlet feature is configured to purge air from the cavity, and wherein the inlet feature and outlet feature are configured for the food bottle to be vacuum sealed;

a first engagement section between the top end of the body member and the bottom end of the neck section of the top member;

a second engagement section between the top end of the neck section of the top member and the cap;

and a seal configured to seal the top end of the body member and the bottom end of the neck section.

2. The vending machine food bottle of claim 1, wherein the seal is made of paper, foil, plastic, or any combination thereof.

3. The vending machine food bottle of claim 1, wherein the seal is attached to the top end of the body portion by an adhesive.

4. The vending machine food bottle of claim 1, further comprising a gasket, wherein the gasket is disposed within the first engagement section between the top end of the body member and the bottom end of the neck section of the top member.

5. The vending machine food bottle of claim 4, wherein the gasket is an o-ring, wherein the o-ring is made of a material selected from the group consisting of rubber, plastic, composite material or any combination thereof.

6. The vending machine food bottle of claim 4, wherein the gasket is a washer, wherein the washer is made of a material selected from the group consisting of rubber, plastic, composite material or any combination thereof.

7. The vending machine food bottle of claim 4, wherein the gasket is attached to the top end of the body section by an adhesive.

8. The vending machine food bottle of claim 4, wherein the gasket is attached to the bottom end of the neck section of the top member by an adhesive.

9. The vending machine food bottle of claim 1, further comprising a sealing band, wherein said sealing band encircles the first engagement section.

10. A vending machine food bottle, comprising:

a body member, the body member comprising a top end and a container section;

a top member separable from the body member, the top member having:

a neck section, the neck section comprising a top end, a bottom end, and an outlet valve;

a cap affixed to the neck section, connected to the outlet valve, and independently sealing the top member;

and an inlet valve connected to the neck section, and an engagement section, wherein the top end of the body member engages with the bottom end of the neck section of the top member;

and a seal, wherein the seal is disposed in the engagement section, between the top end of the body member and the bottom end of the neck section, wherein the inlet valve and outlet valve are each configured to be independently sealed, and wherein the inlet valve is configured to receive a pressurizing device for purging the food bottle of air.

11. The vending machine food bottle of claim 10, wherein the seal is made of paper, foil, plastic, or any combination thereof.

12. The vending machine food bottle of claim 10, wherein the seal is attached to the top end of the body portion by an adhesive.

13. The vending machine food bottle of claim 10, further comprising a gasket, wherein the gasket is disposed within the engagement section between the top end of the body member and the bottom end of the neck section of the top member.

14. The vending machine food bottle of claim 13, wherein the gasket is an o-ring, wherein the o-ring is made of a material selected from the group consisting of rubber, plastic, composite material or any combination thereof.

15. The vending machine food bottle of claim 4, wherein the gasket is a washer, wherein the washer is made of a material selected from the group consisting of rubber, plastic, composite material or any combination thereof.

16. The vending machine food bottle of claim 4, wherein the gasket is attached to the top end of the body section by an adhesive.

17. The vending machine food bottle of claim 4, wherein the gasket is attached to the bottom end of the neck section of the top member by an adhesive.

18. The vending machine food bottle of claim 10, further comprising a sealing bond, wherein said sealing bond encircles the engagement section.

19. A vending machine food bottle, comprising:

a body member having a top end and a container section, wherein the body member defines a cavity configured to store food items;

a top member, separable from the body member, having a neck section, wherein the neck section comprises a top end and a bottom end, and wherein the top member is configured to store food items;

a cap releasably threaded to the top end of the top member, wherein the cap independently seals the top end of the top section;

an engagement section, wherein the top end of the body member engages with the bottom end of the neck section of the top member;

an outlet feature located on the neck of the top member and configured to receive an inert gas and to be independently sealed, the inlet valve also being configured to receive a pressurizing device, wherein, the body member can receive a food item into the container section, the top member can be secured to the body member via the engagement section and the air can be purged and replaced via the outlet and inlet valves to store the food item for purchase by a consumer.

20. The vending machine food bottle of claim 19 and further comprising a seal surrounding the engagement section configured to form an airtight seal of the engagement section.

* * * * *